US005762218A

United States Patent [19]

Sachau

[11] Patent Number: 5,762,218

[45] Date of Patent: Jun. 9, 1998

[54] PLASTIC CLOSURE RETAINED BY SNAPPING OVER BOTTLE NECK BEAD

[75] Inventor: Werner Sachau, Lohne, Germany

[73] Assignee: Franz Rossberg, Werlte, Germany

[21] Appl. No.: 809,958

[22] PCT Filed: Oct. 5, 1995

[86] PCT No.: PCT/EP95/03938

§ 371 Date: May 7, 1997

§ 102(e) Date: May 7, 1997

[87] PCT Pub. No.: WO96/11149

PCT Pub. Date: Apr. 18, 1996

[30] Foreign Application Priority Data

Oct. 6, 1994 [DE] Germany ..... 9416093 U

[51] Int. Cl.[6] ..... B65D 41/16

[52] U.S. Cl. ..... 215/320; 215/352; 215/354

[58] Field of Search ..... 215/320, 325, 215/352, 354

[56] References Cited

U.S. PATENT DOCUMENTS

| | | | |
|---|---|---|---|
| 2,850,193 | 9/1958 | Wieckmann et al. | 215/320 |
| 3,074,579 | 1/1963 | Miller | 215/354 X |
| 3,164,278 | 1/1965 | Lohrer | 215/320 |
| 3,335,893 | 8/1967 | Hanson | 215/254 |
| 3,494,496 | 2/1970 | Livingstone | 215/320 |
| 3,872,993 | 3/1975 | Aichinger et al. | 215/320 |
| 3,899,097 | 8/1975 | Aichinger | 215/253 |
| 4,090,630 | 5/1978 | Wiedmer | 215/320 |
| 4,257,526 | 3/1981 | Weits et al. | 215/332 |

FOREIGN PATENT DOCUMENTS

| | | |
|---|---|---|
| 554028 | 8/1993 | European Pat. Off. . |
| 1154161 | 10/1957 | France . |
| 2234205 | 6/1974 | France . |
| 4203238 | 8/1993 | Germany . |
| 1529445 | 10/1978 | United Kingdom . |

*Primary Examiner*—Stephen Cronin
*Attorney, Agent, or Firm*—Jordan and Hamburg

[57] ABSTRACT

A plastics seal for a bottle having a beaded rim comprises a sealing cap (3), which comprises a circular flat cover plate (2) and on the underside (4) of which are provided an outer ring (5), which, in the locking position, embraces the bottle neck, and an inner sealing ring (6) which abuts at least regionally against the inner circumference of the bottle opening in the manner of a tight cap, the two rings (5, 6), which are arranged substantially concentrically relative to the central longitudinal axis (7), being integrally moulded on to the cover plate (2). The inner sealing ring (6) is provided on its inner side (10, 10') which is opposite the contract surface (9; 9') with a plurality of reinforcing ribs (11) which extend substantially parallel relative to the central longitudinal axis (7) and are designed to be shaped parts (12; 12'; 12"; 12'"; 12"") which at least regionally provide a flexible supporting engagement for the inner sealing ring (6) when disposed in the sealing position.

25 Claims, 6 Drawing Sheets

PLASTIC CLOSURE RETAINED BY SNAPPING OVER BOTTLE NECK BEAD

Figure 1:
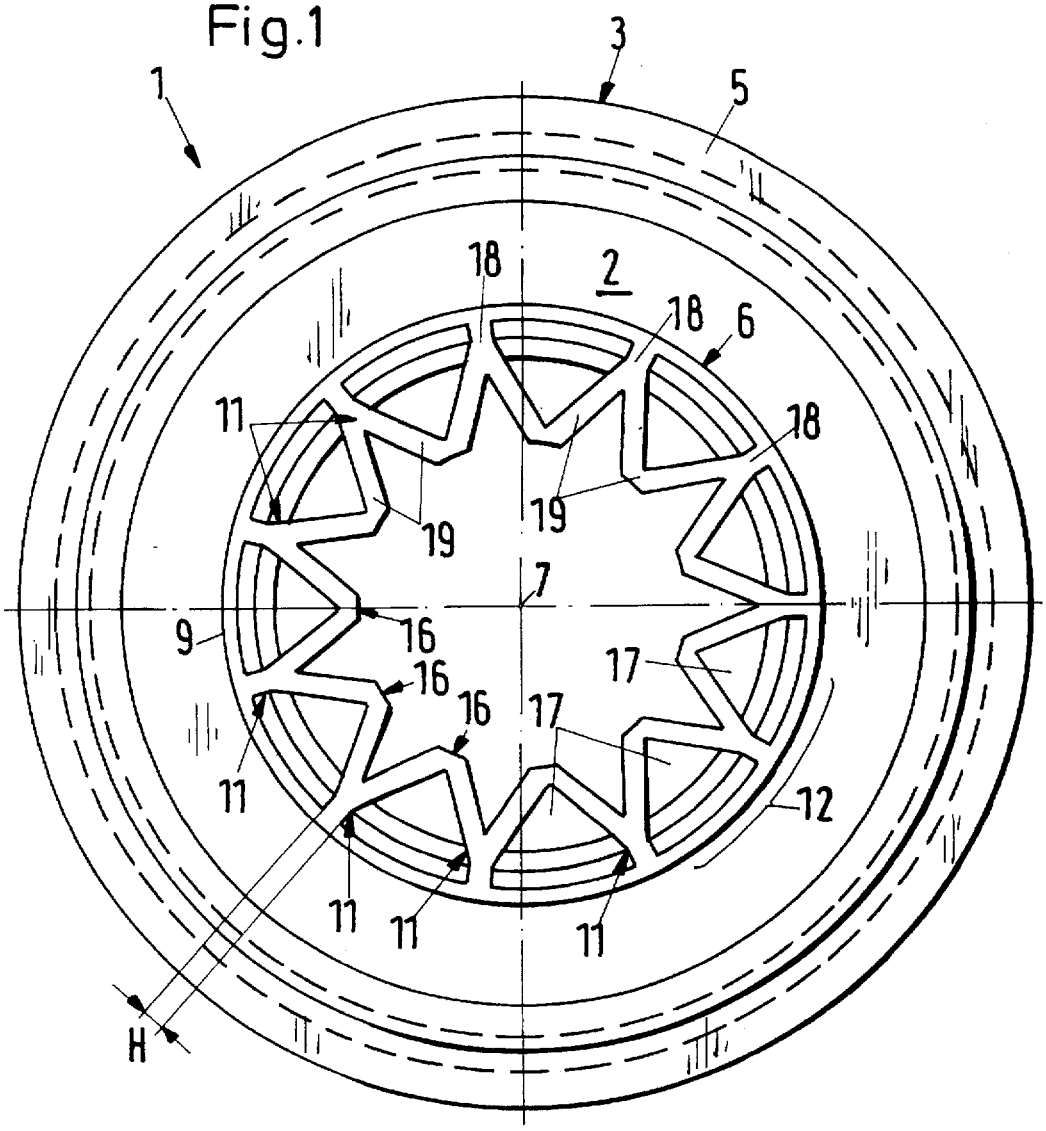

The invention relates to a plastics seal for a bottle having a beaded rim, which seal comprises a sealing cap, which comprises a circular flat cover plate and on the underside of which are provided an outer ring, which, in the locking position, embraces the bottle neck, and an inner sealing ring which abuts at least regionally against the inner circumference of the bottle opening in the manner of a tight cap, the two rings, which are arranged substantially concentrically relative to the central longitudinal axis, being integrally moulded on to the cover plate.

Known plastics seals of this kind (DE 'Offenlegungsschrift' 21 04 543) are provided with a cap member and a sealing ring, which serves as a sealing member and abuts against the inner rim of the opening of a bottle having a beaded rim, and which, in turn, comprises a packing collar and a circular pleat which is arranged coaxially with said collar. Plastics seals of this kind involve unfavourably high production costs, owing to their complicated manufacture and mounting, and their range of application is limited.

The invention is based on the object of providing a plastics seal for a bottle having a beaded rim, which seal is inexpensive to manufacture and ensures a satisfactory tightness when used in bottle openings having different diameter variations.

This object is met essentially thereby that the inner sealing ring is provided on its inner side which is opposite the contact surface with a plurality of reinforcing ribs which extend substantially parallel relative to the central longitudinal axis and are designed to be shaped parts which at least regionally provide a flexible supporting engagement for the inner sealing ring when disposed in the sealing position. Further features and advantageous developments are set out in the subsidiary claims.

The plastics seal, designed according to the invention, for a bottle having a beaded edge, is designed to have a plurality of reinforcing ribs in the region of its sealing cap member which abuts against the inner circumference of the bottle opening, which reinforcing ribs engage behind the inner sealing ring on its inner side opposite the contact surface, and which are arranged in a parallel arrangement relative to the central longitudinal axis, by means of which ribs the inner sealing ring is provided not only with a sufficient stability but also with flexibility, and by means of which a tolerance compensation in the region of the contact surface with respect to the bottle opening is possible.

By means of the reinforcing ribs, it is possible for the sealing ring, which is, all in all, thin-walled, to accommodate a deformation of the sealing cap member, which deformation arises from the pressing fiting, in particular when introduced into the bottle opening, such that the tightness is ensured with adequate reliability along the entire inner circumference, while simultaneously preventing unfavourable deformations of the top cap member.

In this regard, the arrangement of the reinforcing ribs permits a thin-walled inner sealing ring, by means of which a flexible adaptation to bottle openings having different tolerances and/or opening contours may be achieved even when a hard plastics material is used. As a result of a convex design of the contact surface, the inner sealing ring has a transitional region which tapers in the direction of the cover plate, such that a transmission of material stresses to the cover plate is prevented and the top of the latter retains an optically pleasant shape.

In the case of the manufacture of the sealing cap as a single part, e.g. by injection moulding, a simple ejection out of the mould is possible as a result of the arrangement of the reinforcing ribs parallel to the axis. It is also conceivable for the reinforcing ribs to be arranged at a certain inclination with respect to the central longitudinal axis, or for the reinforcing ribs to be designed to be curved, the technical limit, in each case, being whether the product is ejectable from the injection moulding tool.

Figure 2:
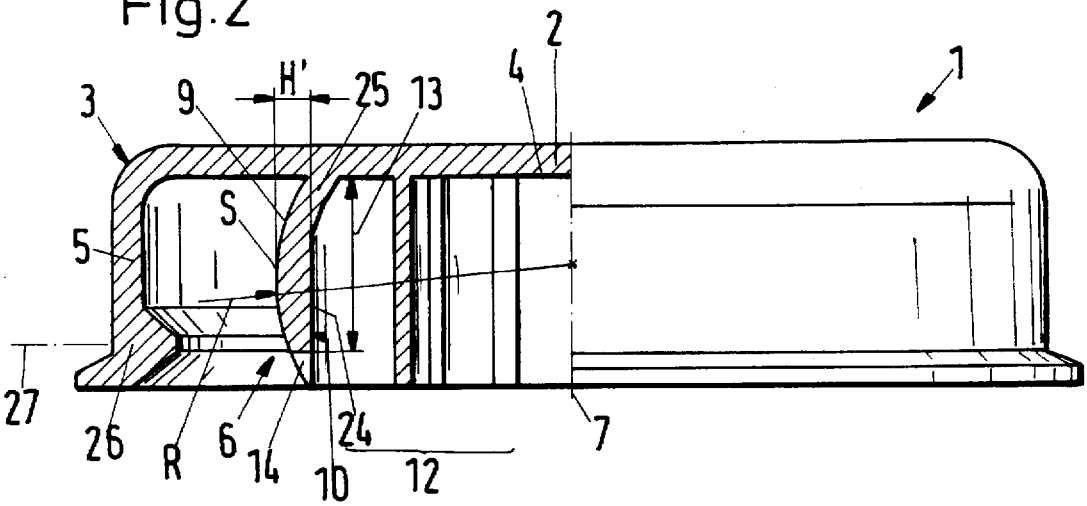
Figure 3:
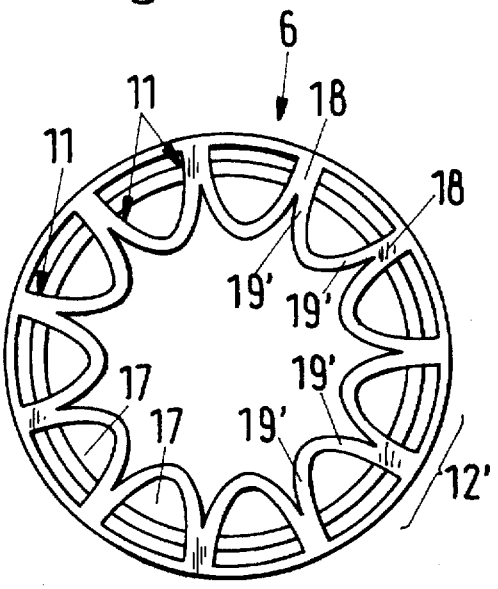
Figure 4:
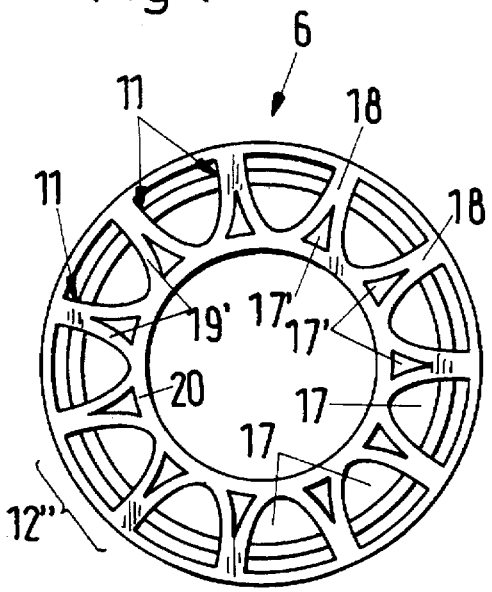
Figure 5:
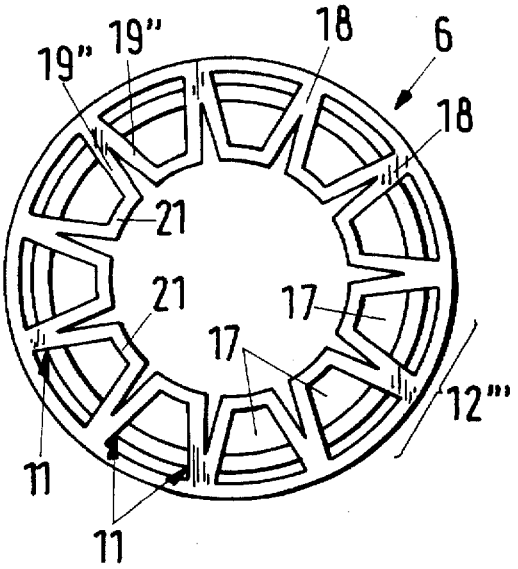
Figure 6:
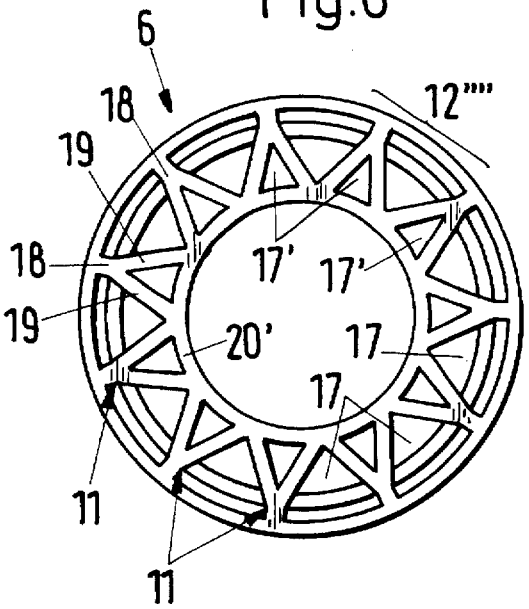
Figure 7:
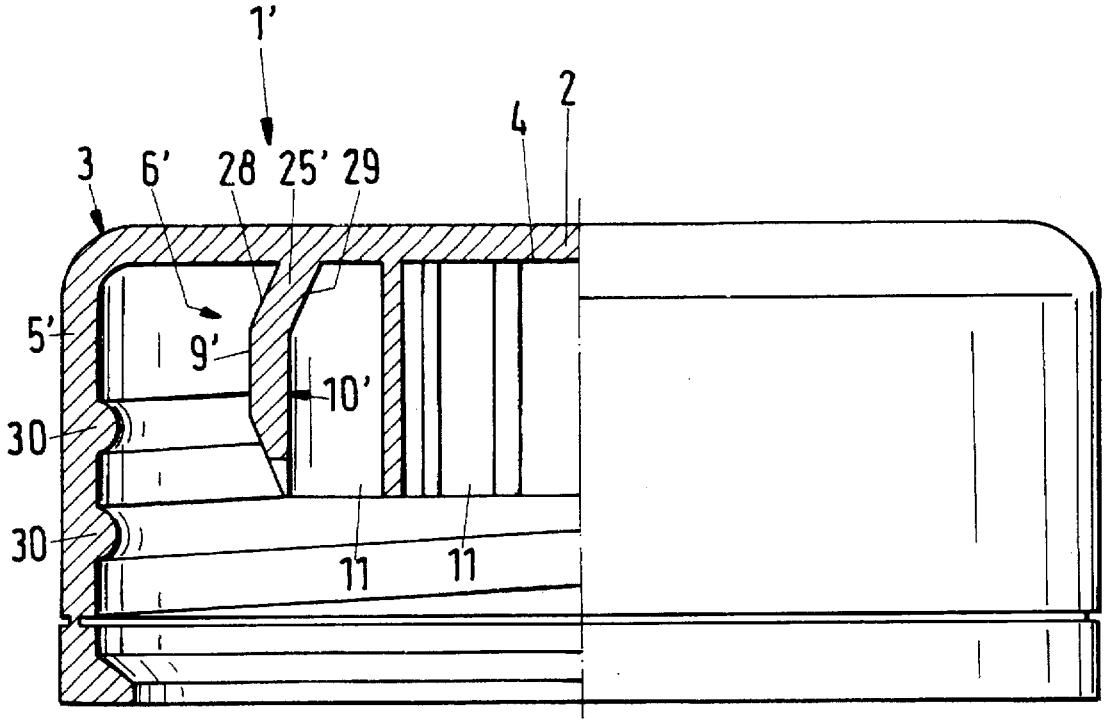
Figure 8:
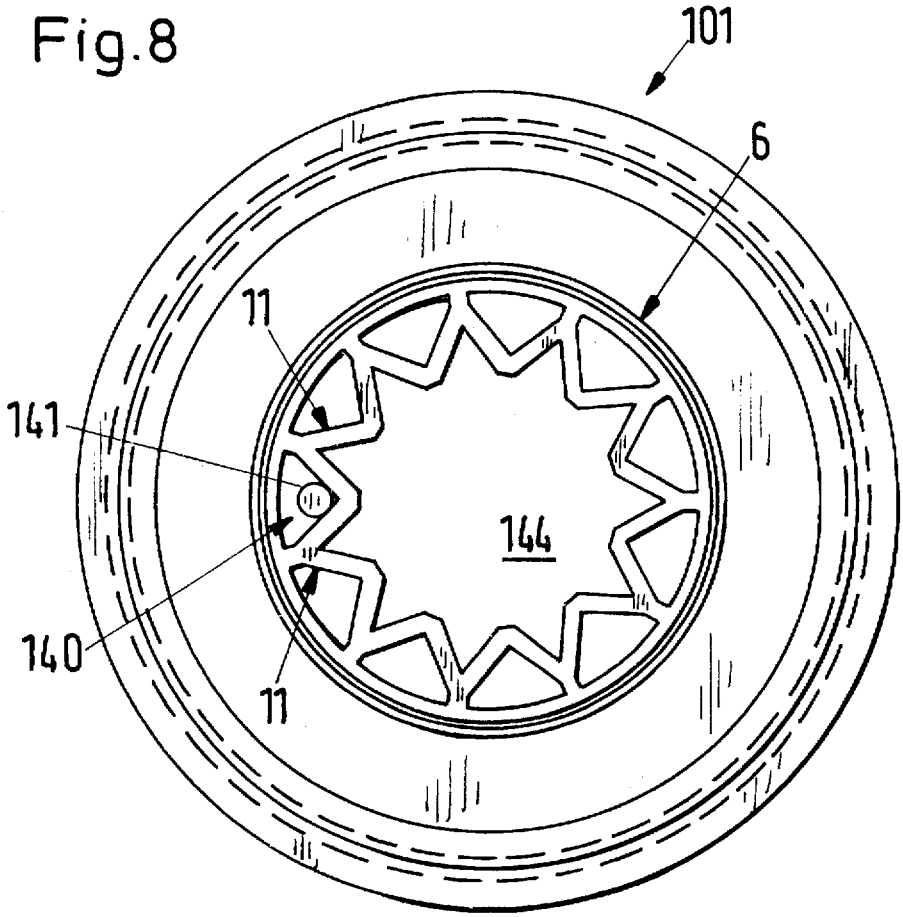
Figure 9:
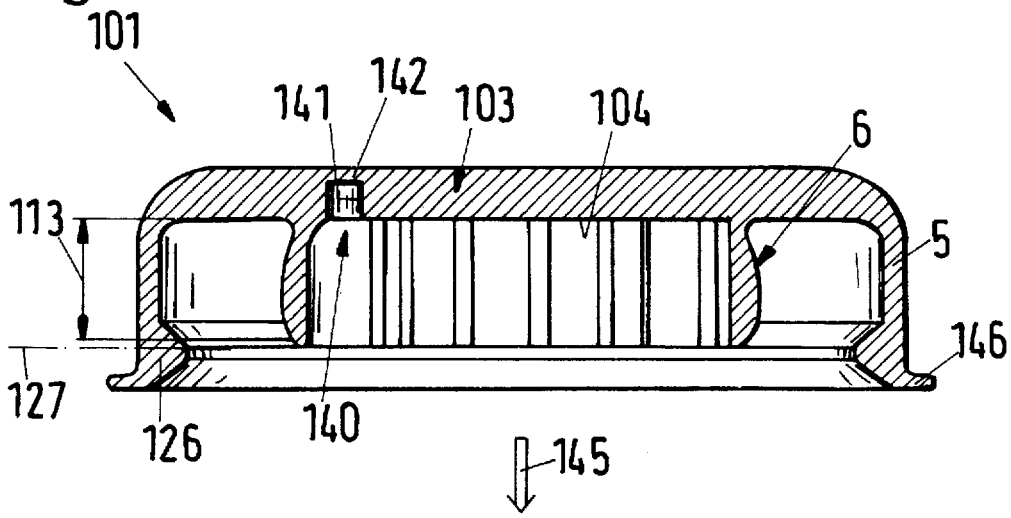
Figure 10:
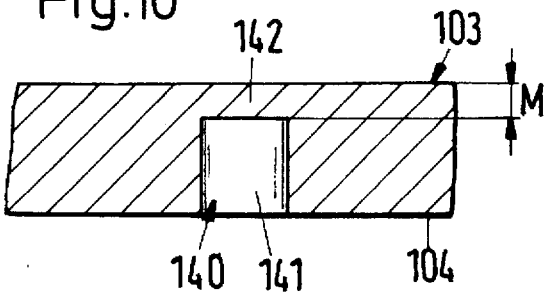
Figure 11:
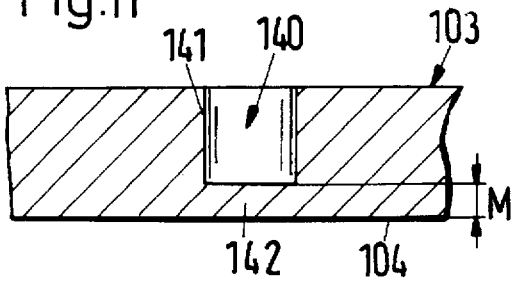
Figure 12:
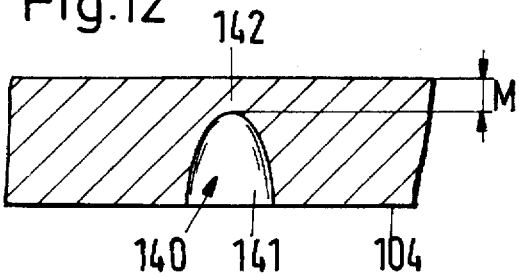
Figure 13:
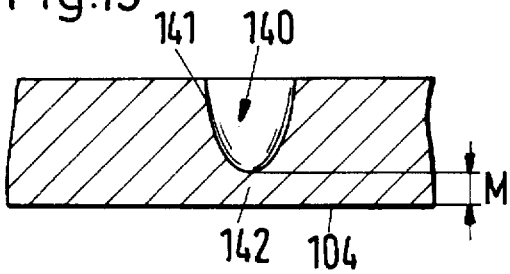
Figure 14:
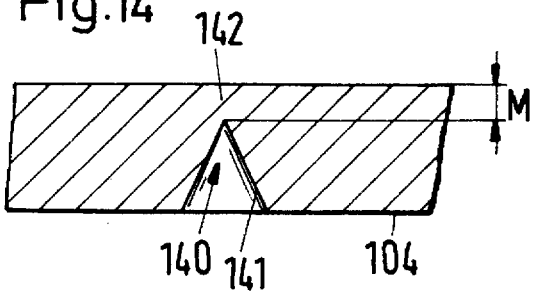
Figure 15:
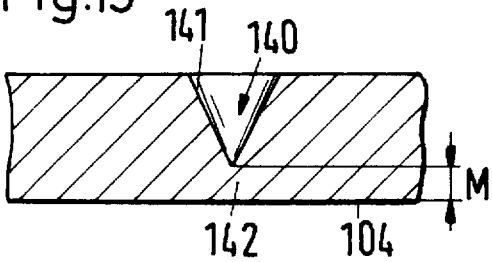
Figure 16:
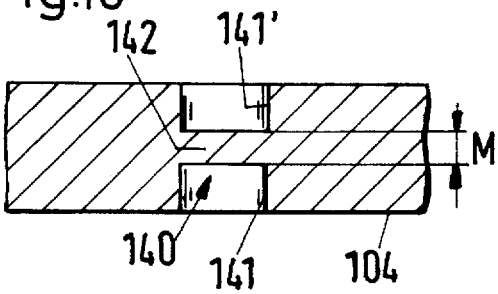
Figure 17:
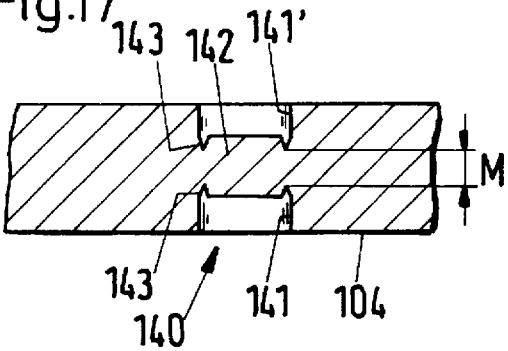
Figure 18:
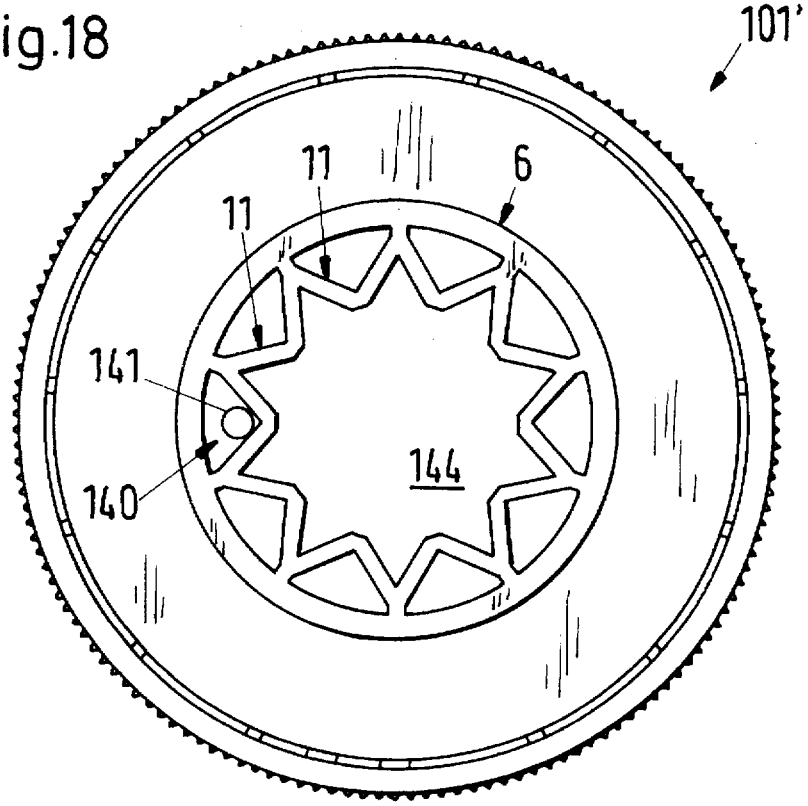
Figure 19:
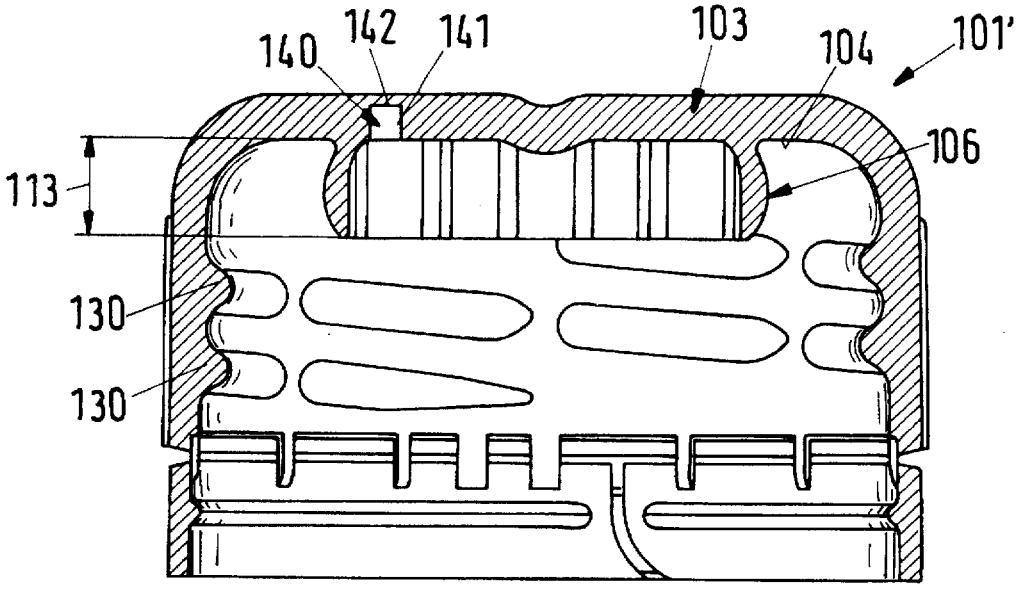

The particulars of the invention are set out in more detail in the following description, with reference to the drawings which show numerous exemplified embodiments of a plastics seal designed according to the invention. In the drawing:

FIG. 1 shows a view from below of the plastics seal of the bottle having a beaded edge, with respective reinforcing ribs in the region of an inner sealing ring, FIG. 2 shows a partially exposed side view of the plastics seal according to FIG. 1, FIGS. 3 to 6 in each case show individual illustrations similar to FIG. 1 with inner sealing rings in which the reinforcing ribs have different forms, FIG. 7 shows a side view similar to FIG. 2, with the plastics seal, in a second embodiment, comprising a thread lug, FIG. 8 shows a view from below of a third embodiment of the plastics seal similar to FIG. 1, comprising a predetermined breaking region in the region of the inner sealing ring, FIG. 9 shows an exposed side view of the plastics seal according to FIG. 8, FIGS. 10 to 17 are, in each case, enlarged illustrations of parts of the plastics seal in the region of the predetermined breaking region, FIG. 18 shows a view from below of a fourth embodiment of the plastics seal comprising a thread lug similar to FIG. 7, and FIG. 19 shows an exposed side view of the plastics seal according to FIG. 18.

FIG. 1 shows a plastics seal which, in its entirety, is designated by reference number 1 and is provided for a bottle having a beaded rim (not illustrated) which is usually sealed using a crown cork. The plastics seal 1 comprises a sealing cap 3, which comprises a circular flat cover plate 2 (FIG. 2), and on the underside 4 of which are provided an outer ring 5, which, in the locking position, embraces the bottle neck of the beaded-rim bottle, and an inner sealing ring 6 which abuts at least regionally against the inner circumference of the bottle opening in the manner of a tight cap. In this regard, the two rings 5, 6 are arranged essentially concentrically relative to the central longitudinal axis 7 and, in an advantageous embodiment, are integrally moulded on the cover plate 2.

In the plastics seal 1 according to the invention the inner sealing ring 6 is provided on its inner side 10, which is opposite the contact surface 9, with a plurality of axially parallel reinforcing ribs 11. In an advantageous embodiment, the reinforcing ribs 11 are thus designed to be moulded parts 12 which are integrally connected to the rear side of the inner sealing ring 6 and the underside 4 of the cover plate 2. The inner sealing ring 6, which, in the sealing position of the sealing cap, is in a supporting engagement with the neck of the bottle, has, in the reinforcing ribs 11, a plurality of shaped elements by means of which not only a region al or localized influence is had on the stiffness of the material but also on the flexibility of the material.

The partially exposed illustration of the plastics seal 1 according to FIG. 2 shows that the reinforcing ribs 11 have a profiled length which, in the axial direction, substantially corresponds to the length of the inner sealing ring 6. In this regard, the reinforcing ribs 11 are provided, at their end which, in the axial direction, is free, with a supporting region 14 which tapers to form a guiding point, by means of which, when the seal 1 is pressed into the neck of the bottle, a smooth centering of the inner sealing ring 6 is ensured.

The view from below according to FIG. 1 shows the overall structural design of the reinforcing ribs 11 which, in each case, form pairs which have a common connecting region 16 at their ends which are free in the direction of the central longitudinal axis 7. Accordingly, a spring chamber 17 is formed, in each case, between the inner side 10 of the inner sealing ring 6 and the reinforcing ribs 11, and the reinforcing ribs 11 form a folded-star-shaped profile in the circumferential direction of the inner sealing ring 6, such that the deformations, which occur when the inner sealing ring 6 is pressed into the neck of the bottle, are distributed uniformly across the entire contact surface 9, thereby ensuring a reliably tight sealing of the bottle. In this regard, the folded-star-shaped profile is integrally connected to the inner sealing ring 6 and also to the cover plate 2.

The illustrations of further embodiments of the plastics seal 1, or of the inner sealing ring 6, according to FIGS. 3 to 6, show that the reinforcing ribs 11 have a similar contour and are designed, in each case starting from a nodal point 18 on the inner side 10 of the inner sealing ring 6, as essentially V-shaped projecting profiled limbs 19 (FIG. 1). In the embodiment according to FIG. 3, the reinforcing ribs 11 are provided in the form of profiled limbs 19' which pass over into each other in the manner of a curve, and, in a further modified embodiment according to FIG. 4, they are interconnected via a common supporting ring 20 at their respective curved regions projecting in the direction of the central axis 7. In the embodiment according to FIG. 5, the respective profiled limbs 19" are provided with a radial connecting web 21, and the embodiment according to FIG. 6 illustrates an amplification of the embodiment shown in FIG. 1, in that a supporting ring 20' is provided on the V-shaped profiled limbs 19.

The exposed view of the plastics seal 1 according to FIG. 2 illustrates the design of the contour of the inner sealing ring 6 which, in cross-section, on the one hand, is provided with a contact surface 9 having a convex shape and, on the other hand, the inner side 10 of which, being connected to the reinforcing ribs 11, is regionally designed as a cylindrical peripheral surface 24. In the upper region, the cylindrical peripheral surface 24 is provided with a transition region 25 which slopes in the direction of the central axis 7, and the convex contact surface 9, in an advantageous embodiment, has a constant radius R which, in this transition region 25, runs into the underside 4 of the cover plate 2.

In order to ensure that the inner sealing ring 6 is securely pressed into the neck of the bottle and that the outer ring 5 embraces the beaded rim of the bottle, the convex contact surface 9 is provided with a summit S, which is formed with respect to the central longitudinal axis 7 and is arranged above a holding plane 27 which is defined by a toric part 26 which is disposed on the outer ring 5 and, in the sealing position, embraces the beaded-rim bottle.

In a second embodiment of the plastics seal 1' according to FIG. 7, the inner sealing ring 6' is designed to have a contour which, in cross-section, is substantially trapezoidal, the transition region 25', which slopes in the direction of the cover plate 2, being provided with parallel annular surfaces 28, 29. In the present embodiment, the contact surface 9' and the inner side 10', which is connected to the reinforcing ribs 11, extend parallel, at least partially. The inner sealing ring 6' is provided on a cover plate 2, which comprises an outer ring 5' having a thread lug 30, by means of which cover plate the plastics seal 1' forms a screw cap for corresponding bottle necks (not illustrated).

In the plastics seals 1, 1' described above, it is possible for the flexibility and the deformability of the inner sealing ring 6 to be influenced structurally at little cost, in that the reinforcing ribs 11 are provided, at the nodal point 18 which, in each case, is disposed on the inner side 10 of the inner sealing ring 6, with a wall thickness H which, in the axial direction, is at least regionally less than the wall thickness H' formed between the contact surface 9 and the inner side 10 (FIGS. 1 and 2), such that unfavourable deformation during the manufacture of the plastics seals 1, 1' are prevented by this ratio of the wall thicknesses.

FIGS. 8 and 18 in each case show views from below of the design of two further embodiments of the plastics seal 101, 101', respectively, which are provided with a recess 141 which forms a predetermined breaking region 140, in each case, in the region of their sealing cap 103. The cross-sectional illustration according to FIGS. 9 and 19, and the respective illustrations of detailed parts according to FIGS. 10 to 17, show the predetermined breaking regions 140 which, in each case, have a recess 141, 141' of a different cross-sectional contour, a web 142 of reduced material thickness M being provided in each case in the floor region of said recess. The cross-sectional contour of the recesses 141, 141' may, in this regard, have any of a variety of forms as shown in FIGS. 16 and 17, in addition to the rectangular form (FIGS. 10 and 11), the arched form (FIGS. 12 and 13) and the triangular form (FIGS. 14 and 15) The double rectangular form according to FIG. 17 in addition, for example, shows additional notches 143 in the web 142, thereby making it possible to reduce the predetermined breaking region to a low thickness of the material.

It is also conceivable for the recess to be designed as an annular groove (not illustrated) which is shaped into the respective sealing cap 103, and it may be provided, in a manner analogous to the recesses 141 illustrated, on the underside 104 and/or, according to 141', on the top of the sealing cap 103.

The cross-sectional illustrations according to FIGS. 9 and 19 show that, in an advantageous embodiment, the recess 141 is arranged in the region between two reinforcing ribs 11 of the respective folded-star-shaped profile. It is, however, also conceivable for the recess 141 to be provided on the underside 104 of the sealing cap 101, 101' in an inner region 141 of the respective inner sealing ring 6, such that the predetermined breaking region 140 may be provided particularly readily and that it is readily accessible for control purposes.

As a result of the predetermined breaking region 140 described above, the plastics seal, which is mounted on bottles having a beaded rim applying, in particular, the crown-cork principle, has a shaping of the material which is readily and economically incorporated in its one-pieced production, for example by injection moulding. When using the plastics seal 101, 101', for example for bottles having a carbon-dioxide-containing content, the predetermined breaking region 140 may be used in the manner of a pressure control valve, thereby providing the bottle with a protection against bursting.

Accordingly, it is possible, in particular when the seal 101, 101' is designed to be of a high-strength plastics material, for its connecting regions may be secured in position in a supporting engagement, which is tight even at a high internal pressure, for example up to 25 bar, via the folded-star-shaped profile, which is located on the inner sealing ring 6, and the toric rim part 26 such that the safety risk is reduced by way of the predetermined breaking region 140, which is incorporated in the cap, even if a bottle material which is susceptible to exploding, e.g. glass, is used. In this regard, it is possible to provide a design of the plastics seal 101, 101' which may be adapted to the various permissible internal pressures in each case, by a corresponding dimensioning of the predetermined breaking region 140, for example of the material thickness M in the region of the web 142.

In an advantageous embodiment, the plastics seals 1, 1'; 101, 101' described above are of polypropylene (PP) or of polyethylene (PE, HDPE), the seals providing a reliable tightness at least at ambient temperatures of from 10° C. to 60° C. in the sealing position, even at internal pressure up to 25 bar or more.

The cross-sectional illustrations according to FIGS. 9 and 19 also show that the inner sealing ring 106 has a profiled length 113 which is set back relative to the holding plane 127 of the toric part 126 (FIG. 9), or relative to the thread lug 130 (FIG. 19), such that, as a result thereof, it is possible not only to economize with regard to the material required for the production of the seals, but also that the forces required to press the plastics seal on to the beaded-rim bottle (not shown) are optimized. During the pressing operation (indicated by arrow 145, FIG. 9), in a first sealing step, the toric part 126 engages across the bottle having a beaded rim, and the inner sealing ring 6, in a second step, then arrives in the connecting position. In so doing, relatively low overall forces are exerted on the plastics seal, damage is prevented and a reliably tight connecting position is ensured.

In an advantageous embodiment, the plastics seals 1, 101 are provided, in the region of their respective outer rings 5, with a moulded edging ring 146, which is deformable when the plastics seal 1, 101 is removed from a bottle, such that it is readily possible for its permanent deformation to demonstrate, with an adequate degree of reliability, that it has been opened, respectively to demonstrate the intactness of the plastics seals 1, 101.

I claim:

1. A plastic cap for a container having an opening with an outside and an inner circumference, comprising a sealing cap having a circular covering section, said circular covering section having an underside, an outer sealing ring extending from said underside of said circular covering section and encircling the outside of the opening of the container, an inner sealing ring extending from said underside of said circular covering section and having an outer side and an inner side, said outer side being disposed at least partially in contact with the inner circumference of the container opening, said sealing cap having a central longitudinal axis, said outer sealing ring and said inner sealing ring each being disposed concentrically with respect to said longitudinal axis, said outer sealing ring and said inner sealing ring being integrally molded as one piece with said circular covering section, said inner sealing ring having a plurality of reinforcing ribs which are parallel to said longitudinal axis, said ribs extending from said inner side of said inner sealing ring, each of said ribs including a pair of legs joined to one another at a nodal portion adjacent the inner side of said inner sealing ring, said pair of legs diverging from one another as said legs extend from said nodal portion.

2. A plastic cap according to claim 1 wherein ribs have a generally V-shaped configuration.

3. A plastic cap according to claim 1 wherein said pair of legs are disposed to form a generally V-shaped rib, said nodal portion of said V-shaped rib being disposed closer to said inner sealing ring than any other part of the V-shaped rib.

4. A plastic cap according to claim 1 wherein each of said legs have a generally arcuate configuration.

5. A plastic cap according to claim 1 wherein said ribs have a generally arch-shaped configuration.

6. A plastic cap according to claim 1 wherein said ribs are juxtaposed to one another, said juxtaposed ribs being joined to one another.

7. A plastic cap according to claim 1 wherein said ribs are spaced from one another.

8. A plastic cap according to claim 1 further comprising a common supporting ring connected to the inner radial ends of said ribs.

9. A plastic cap according to claim 1 wherein the inner side of the inner sealing ring and the legs of said ribs form the boundaries of chambers which are open at one end.

10. A plastic cap according to claim 1 wherein said inner sealing ring has an axial cross sectional configuration in which the outer side of said inner sealing ring has a partial cylindrical surface and a transitional surface between said cylindrical surface and said underside of said circular covering section, said transitional surface being inclined relative to said longitudinal axis.

11. A plastic cap according to claim 1 wherein said outer side of said inner sealing ring has a partial circular surface having a constant radius when viewed in cross section along an axial cutting plane, the center of said radius being disposed on said longitudinal axis.

12. A plastic cap according to claim 1 wherein said container has a beaded edge, said partial circular surface having an outermost summit defining a summit plane perpendicular to said longitudinal axis, said outer sealing ring having an inner toroidal projection embracing said beaded edge on said container, said toroidal projection defining a holding plane perpendicular to said longitudinal axis, said summit plane being spaced from said circular covering section a first distance, said holding plane being spaced from said circular covering section a second distance which is greater than said first distance.

13. A plastic cap according to claim 1 wherein said inner sealing ring includes a first portion and a transition portion, said first portion, in axial cross section, having a substantially trapezoidal configuration, said transition portion extending between said first portion and said circular covering section, said transition portion having parallel annular surfaces which slope radially inwardly as said circular covering section is approached.

14. A plastic cap according to claim 1 wherein the nodal portion of each rib is juxtaposed to said inner sealing ring, said nodal portion having a thickness in a circumferential direction which is, at least in some regions, less than the wall thickness of said inner sealing ring.

15. A plastic cap according to claim 1 wherein said outer sealing ring has a threaded projection.

16. A plastic cap according to claim 1 further comprising safety control means on said circular covering section, said safety control means being operable to break away when the inside of said container attains an elevated predetermined pressure to thereby relieve the elevated pressure in said container and prevent bursting of said container.

17. A plastic cap according to claim 16 wherein said circular covering section has an area of substantially constant thickness, said safety control means including a reduced thickness area on said circular covering section, said reduced thickness area being thinner than said area of substantially constant thickness.

18. A plastic cap according to claim 16 wherein said safety control means is disposed between two legs of one of said ribs.

19. A plastic cap according to claim 16 wherein said safety control means includes an inner recess on said circular covering section.

20. A plastic cap according to claim 16 wherein said safety control means includes an outer recess on said circular covering section.

21. A plastic cap according to claim 16 wherein said safety control means includes an inner recess on said circular covering section and an outer recess on said circular covering section.

22. A plastic cap according to claim 16 wherein said safety control means comprises an annular groove in said circular covering section.

23. A plastic cap according to claim 1 wherein said outer sealing ring has at least one part having a first axial length, said inner sealing ring having at least one part having a second axial length which is less than said first axial length.

24. A plastic cap according to claim 1 further including a protruding edge on said outer sealing ring which is permanently deformed during removal of the cap from the container to thereby indicate that the container has been opened.

25. A plastic cap for a container having an opening with an outside and an inner circumference, comprising a sealing cap having a circular covering section, said circular covering section having an underside, an outer sealing ring extending from said underside of said circular covering section and encircling the outside of the opening of the container, an inner sealing ring extending from said underside of said circular covering section and having an outer side and an inner side, said outer side being disposed at least partially in contact with the inner circumference of the container opening, said sealing cap having a central longitudinal axis, said outer sealing ring and said inner sealing ring each being disposed concentrically with respect to said longitudinal axis, said outer sealing ring and said inner sealing ring being integrally molded as one piece with said circular covering section, said inner sealing ring having a plurality of reinforcing ribs which are parallel to said longitudinal axis, said plurality of ribs extending from said inner side of said inner sealing ring to form a star-shaped profile when viewed in a cutting plane perpendicular to said longitudinal axis, each of said plurality of ribs having converging legs which converge to a nodal region adjacent the inner side of said inner sealing ring, said legs being joined at said nodal region.

* * * * *